US008800690B2

(12) United States Patent
Lyon et al.

(10) Patent No.: US 8,800,690 B2
(45) **Date of Patent: *Aug. 12, 2014**

(54) DOWN-THE-HOLE DRILL HAMMER HAVING A REVERSE EXHAUST SYSTEM AND SEGMENTED CHUCK ASSEMBLY

(75) Inventors: Leland H. Lyon, Roanoke, VA (US); Warren Thomas Lay, Catawba, VA (US)

(73) Assignee: Center Rock Inc., Berlin, PA (US)

( * ) Notice: Subject to any disclaimer, the term of this patent is extended or adjusted under 35 U.S.C. 154(b) by 557 days.

This patent is subject to a terminal disclaimer.

(21) Appl. No.: 12/621,155

(22) Filed: Nov. 18, 2009

(65) Prior Publication Data

US 2010/0059284 A1 Mar. 11, 2010

Related U.S. Application Data

(63) Continuation-in-part of application No. 12/361,263, filed on Jan. 28, 2009, now Pat. No. 8,302,707, and a continuation-in-part of application No. PCT/US2009/038957, filed on Mar. 31, 2009.

(60) Provisional application No. 61/040,817, filed on Mar. 31, 2008.

(51) Int. Cl.

| | |
|---|---|
| ***E21B 4/14*** | (2006.01) |
| ***E21B 1/38*** | (2006.01) |
| ***E21B 31/16*** | (2006.01) |

(52) U.S. Cl.

USPC ..... 175/296; 175/17; 175/78; 175/135; 175/89

(58) Field of Classification Search

CPC ..... E21B 4/14

USPC ..... 175/135, 136, 15, 17, 296, 293; 173/91, 173/17, 78

See application file for complete search history.

(56) References Cited

U.S. PATENT DOCUMENTS

| | | | | |
|---|---|---|---|---|
| 1,815,660 | A | 7/1931 | Walker | |
| 2,038,602 | A * | 4/1936 | Redinger | 279/32 |

(Continued)

FOREIGN PATENT DOCUMENTS

| | | |
|---|---|---|
| EP | 1910640 B1 | 4/2008 |
| KR | 10-2006-0106388 | 10/2006 |

(Continued)

OTHER PUBLICATIONS

International Search Report and Written Opinion for the related International Application No. PCT/US2010/021011 issued Mar. 19, 2010.

(Continued)

*Primary Examiner* — James Sayre
(74) *Attorney, Agent, or Firm* — Kim Winston LLP

(57) ABSTRACT

A down-the-hole drill hammer is provided that includes a housing, a solid core piston mounted within the housing, a seal located between the solid core piston and the housing, and a backhead configured to exhaust working fluid volumes about a proximal end of the DHD hammer. The backhead includes a check valve assembly having a plug seal that can be moved to a closed seal position by gravity. A DHD hammer having a segmented chuck assembly is also provided. The segmented chuck assembly includes a plurality of chuck segments forming a cylindrical chuck assembly.

37 Claims, 9 Drawing Sheets

(56) References Cited

U.S. PATENT DOCUMENTS

| | | | | |
|---|---|---|---|---|
| 2,379,472 | A | 7/1945 | Bowman | |
| 2,710,740 | A * | 6/1955 | Dempsey | 175/92 |
| 3,893,521 | A * | 7/1975 | Bailey et al. | 173/80 |
| 3,991,834 | A | 11/1976 | Curington | |
| 4,050,525 | A * | 9/1977 | Kita | 173/17 |
| 4,085,809 | A | 4/1978 | Lovell et al. | |
| 4,333,537 | A | 6/1982 | Harris et al. | |
| 4,530,408 | A * | 7/1985 | Toutant | 173/17 |
| 4,691,779 | A | 9/1987 | McMahan et al. | |
| 4,765,418 | A | 8/1988 | Ennis | |
| 4,819,739 | A | 4/1989 | Fuller | |
| 4,878,550 | A | 11/1989 | Chuang | |
| 4,919,221 | A * | 4/1990 | Pascale | 175/415 |
| 5,065,827 | A | 11/1991 | Meyers et al. | |
| 5,085,284 | A | 2/1992 | Fu | |
| 5,301,761 | A | 4/1994 | Fu et al. | |
| 5,305,837 | A | 4/1994 | Johns et al. | |
| 5,322,136 | A | 6/1994 | Bui et al. | |
| 5,322,139 | A | 6/1994 | Rose et al. | |
| 5,398,772 | A | 3/1995 | Edlund | |
| 5,794,516 | A | 8/1998 | Wolfer et al. | |
| 5,915,483 | A | 6/1999 | Gien | |
| 5,984,021 | A | 11/1999 | Pascale | |
| RE36,848 | E | 9/2000 | Bui et al. | |
| 6,125,952 | A | 10/2000 | Beccu et al. | |
| 6,131,672 | A | 10/2000 | Beccu et al. | |
| 6,135,216 | A | 10/2000 | Lyon et al. | |
| 6,170,581 | B1 * | 1/2001 | Lay | 175/296 |
| 6,237,704 | B1 | 5/2001 | Lay | |
| 6,263,969 | B1 | 7/2001 | Stoesz et al. | |
| D454,143 | S | 3/2002 | Åsberg | |
| 6,502,650 | B1 | 1/2003 | Beccu | |
| 6,637,520 | B1 | 10/2003 | Purcell | |
| 6,698,537 | B2 * | 3/2004 | Pascale et al. | 175/300 |
| 6,708,784 | B1 | 3/2004 | Borg | |
| 7,017,682 | B2 | 3/2006 | Chan et al. | |
| 7,117,939 | B1 * | 10/2006 | Hawley et al. | 166/99 |
| 7,159,676 | B2 | 1/2007 | Lyon | |
| 7,163,058 | B2 | 1/2007 | Bakke et al. | |
| 7,198,120 | B2 | 4/2007 | Gien | |
| 7,389,833 | B2 | 6/2008 | Walker et al. | |
| 7,467,675 | B2 | 12/2008 | Lay | |
| 7,617,889 | B2 | 11/2009 | Beccu | |
| 8,312,944 | B2 | 11/2012 | Marshall et al. | |
| 2003/0102167 | A1 | 6/2003 | Pascale et al. | |
| 2004/0188146 | A1 | 9/2004 | Egerstrom | |
| 2006/0225885 | A1 | 10/2006 | Mcgarian et al. | |
| 2006/0249309 | A1 | 11/2006 | Cruz | |
| 2007/0039761 | A1 | 2/2007 | Cruz | |
| 2007/0102196 | A1 | 5/2007 | Bassinger | |
| 2008/0087473 | A1 | 4/2008 | Hall et al. | |
| 2008/0156539 | A1 | 7/2008 | Ziegenfuss | |
| 2010/0059284 | A1 | 3/2010 | Lyon et al. | |
| 2010/0089649 | A1 | 4/2010 | Welch et al. | |
| 2010/0243333 | A1 | 9/2010 | Purcell | |
| 2010/0252330 | A1 | 10/2010 | Gilbert et al. | |
| 2011/0303464 | A1 | 12/2011 | Mulligan | |
| 2012/0006598 | A1 * | 1/2012 | Lyon et al. | 175/296 |
| 2012/0118648 | A1 | 5/2012 | Lorger | |

FOREIGN PATENT DOCUMENTS

| | | | |
|---|---|---|---|
| WO | 2007010513 | A1 | 1/2007 |
| WO | 2007077547 | A1 | 7/2007 |
| WO | 2010082889 | | 7/2010 |

OTHER PUBLICATIONS

Office Action for the related U.S. Appl. No. 12/361,263 issued Jun. 24, 2010.
International Search Report and Written Opinion for the related International Application No. PCT/US2009/038957 issued on May 26, 2009; 8 pages.
International Preliminary Report on Patentability issued on Oct. 5, 2010 in International Application No. PCT/US2009/038957.
Office Action Issued Dec. 7, 2010 in U.S. Appl. No. 12/361,263.
Written Opinion Issued Feb. 22, 2011 in Int'l Application No. PCT/US2010/021011, 4 pages.
Office Action issued May 17, 2011 in U.S. Appl. No. 12/361,263.
Int'l Search Report issued May 31, 2011 in Int'l Application No. PCT/US2010/056917; Written Opinion.
Office Action issued Sep. 15, 2011 in AU Application No. 2009231791.
Office Action issued Feb. 7, 2012 in Chilean Patent Application No. 1015/2010.
International Preliminary Report on Patentability issued Mar. 13, 2012 in International Application No. PCT/US2010/021011.
Office Action issued Feb. 1, 2012 in AU Application No. 2009231791.
Office Action issued Jun. 30, 2011 in SE Application No. 1051069-1.
Office Action issued Jan. 19, 2012 in U.S. Appl. No. 12/361,263.
Office Action issued May 10, 2012 in U.S. Appl. No. 12/361,263.
Office Action issued Jun. 4, 2012 in Canadian App. No. 2,718,669.
Office Action issued May 14, 2012 in Swedish App. No. 1150769-6.
Office Action issued Jun. 21, 2012 in Swedish App. No. 1150985-8.
Office Action issued Nov. 8, 2012 in Canadian App. No. 2,750,810.
Examination Report issued Dec. 7, 2012 in Australian App. No. 2010208528.
Office Action issued May 31, 2013 in Australian Application No. 2011235927.
Office Action issued May 7, 2013 in Chilean Application No. 1785-2011.
Office Action issued Mar. 13, 2013 in U.S. Appl. No. 12/909,495.
Office Action issued Mar. 22, 2013 in Swedish Application No. 1250524-4.
Office Action issued Apr. 17, 2013 in Swedish Application No. 1051069-1.
Office Action issued Apr. 15, 2013 in Korean Application No. 10-2011-7019644.
Office Action issued May 14, 2013 in U.S. Appl. No. 12/933,041.
Office Action issued May 9, 2013 in Canadian Application No. 2,755,592.
Office Action issued May 10, 2013 in Canadian Application No. 2,750,810.
Office Action issued Aug. 26, 2013 in U.S. Appl. No. 12/909,495.
Office Action issued Oct. 25, 2013 in U.S. Appl. No. 12/933,041.
Office Action issued Oct. 24, 2013 in Korean Patent Application No. 2012-7015756.
Office Action issued Dec. 27, 2013 in U.S. Appl. No. 12/933,041.

* cited by examiner

DOWN-THE-HOLE DRILL HAMMER HAVING A REVERSE EXHAUST SYSTEM AND SEGMENTED CHUCK ASSEMBLY

CROSS REFERENCE TO RELATED APPLICATIONS

The present application is a continuation-in-part of U.S. patent application Ser. No. 12/361,263, filed Jan. 28, 2009, entitled "Down-the-Hole Drill Reverse Exhaust System" and International Application No. PCT/US2009/38957 filed Mar. 31, 2009, which claims the benefit of priority pursuant to 35 U.S.C. §119(e) of U.S. Provisional Patent Application No. 61/040,817, filed Mar. 31, 2008, the entire disclosures of which are hereby incorporated herein by reference.

BACKGROUND OF THE INVENTION

The present invention relates to a down-the-hole drill ("DHD") hammer. In particular, the present invention relates to a DHD hammer having a reverse exhaust system and a segmented chuck assembly.

Typical DHD hammers include a piston that is moved cyclically with high pressure gas (e.g., air). The piston generally has two end surfaces that are exposed to working air volumes i.e., a return volume and a drive volume that are filled and exhausted with each cycle of the piston. The return volume pushes the piston away from its impact point on a bit end of the hammer. The drive volume accelerates the piston toward the impact point.

Typical DHD hammers also combine the exhausting air from the working air volumes into one central exhaust gallery that delivers all the exhausting air through the drill bit and around the externals of the DHD hammer. In most cases, about 30% of the air volume is from the DHD hammer's return chamber, while about 70% is from the hammer's drive chamber. However, this causes much more air then is needed to clean the bit-end of the hammer (e.g., the holes across the bit face). Such high volume air passes through relatively small spaces creating high velocity flows as well as backpressure within the DHD hammer. This is problematic as such high velocity air along with solids (e.g., drill cuttings) and liquids moved by the high velocity air causes external parts of the DHD hammer to wear more rapidly while backpressures within the DHD hammer reduces the tool's overall power and performance.

Further, when DHD hammers are used, the DHD hammer is typically immersed in water that includes drill cuttings and debris. Such water and debris can have adverse effects upon a DHD hammer's operation and performance if allowed to enter the internal areas of the DHD hammer. Notwithstanding, conventional DHD hammers typically include a piston with a thru-hole that allows for working air volumes from the drive chamber to be exhausted through the piston and out through the drill bit. As such, an open flow path exists for fluids to exit the DHD hammer's drive chamber through the drill bit. This in turn provides an open flow path for fluids to enter the drive chamber when working fluid volumes are not being exhausted from the DHD hammer, such as when the DHD hammer is not being used, yet is still immersed in the drill hole. This frequently occurs when drill pipes are added to a drill sting to advance a bore hole.

Typical DHD hammers also include a chuck assembly having an integrally formed chuck i.e., a chuck formed as a single part. Such typical chucks, which are threadedly connected to the DHD hammer casing operate to engage shank splines of a drill bit to provide for rotational movement. This movement of the drill bit within the chuck however, results in increased shank stresses created by the relatively small torque transmission diameter of the shank compared to the head of the drill bit and because of the high intensity elastic strain wave that passes through the small diameter section of the shank during impact. As a result, localized burning and/or galling of the shank splines in the area between the head of the drill bit and the chuck often results, which can lead to accelerated fatigue failure and then part failure. Accordingly, there is a need for a DHD hammer that is not limited by the aforementioned problems associated with conventional DHD hammers.

BRIEF SUMMARY OF THE INVENTION

In a preferred embodiment, the present invention provides a down-the-hole drill hammer comprising a housing, a solid core piston within the housing, a seal located between the solid core piston and the housing, and a backhead configured within the housing and superior to the solid core piston. The backhead includes an exhaust port in communication with an opening in the housing, an exhaust valve stem in communication with the exhaust port, and a check valve assembly. The check valve assembly is configured to seal the exhaust valve stem when in a closed configuration.

In another preferred embodiment, the present invention provides a down-the-hole drill hammer comprising a housing, a piston mounted within the housing, a drill bit mounted about a distal end of the housing, and a segmented chuck assembly circumscribing the drill bit. The piston is configured to reciprocatively move within the housing along a longitudinal direction. The drill bit includes a head and a shank having a shoulder. The segmented chuck assembly circumscribes the drill bit and includes a plurality of chuck segments. Each of the plurality of chuck segments includes a proximal end connectable to the housing, a distal end configured to receive the shank of the drill bit, and a flange configured to operatively engage the shoulder of the shank.

In yet another preferred embodiment, the present invention provides a segmented chuck assembly for a down-the-hole drill hammer comprising a plurality of chuck segments for circumscribing a drill bit. Each of the plurality of chuck segments includes a proximal end connectable to a down-the-hole drill hammer housing, a distal end configured for receiving the drill bit, and a flange configured for operatively engaging the drill bit.

In a further preferred embodiment, the present invention provides a down-the-hole hammer comprising a housing, a piston, a drill bit and a chuck assembly. The piston is mounted within the housing and configured to reciprocatively move within the housing along a longitudinal direction. The drill bit is located proximate a distal end of the housing. The drill bit includes a head, a bit shoulder proximate a proximal end of the head, and a shank that extends proximally from the head. The shank includes an impact surface about a proximal end of the shank, a shoulder proximate a proximal end of the shank, a plurality of shank splines about a distal end of the shank, and a thrust shoulder proximate a proximal end of the plurality of shank splines and distal to the impact surface. The chuck assembly is connected to the housing and circumscribes the drill bit. The chuck assembly includes a flange in direct contact with the thrust shoulder of the drill bit.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
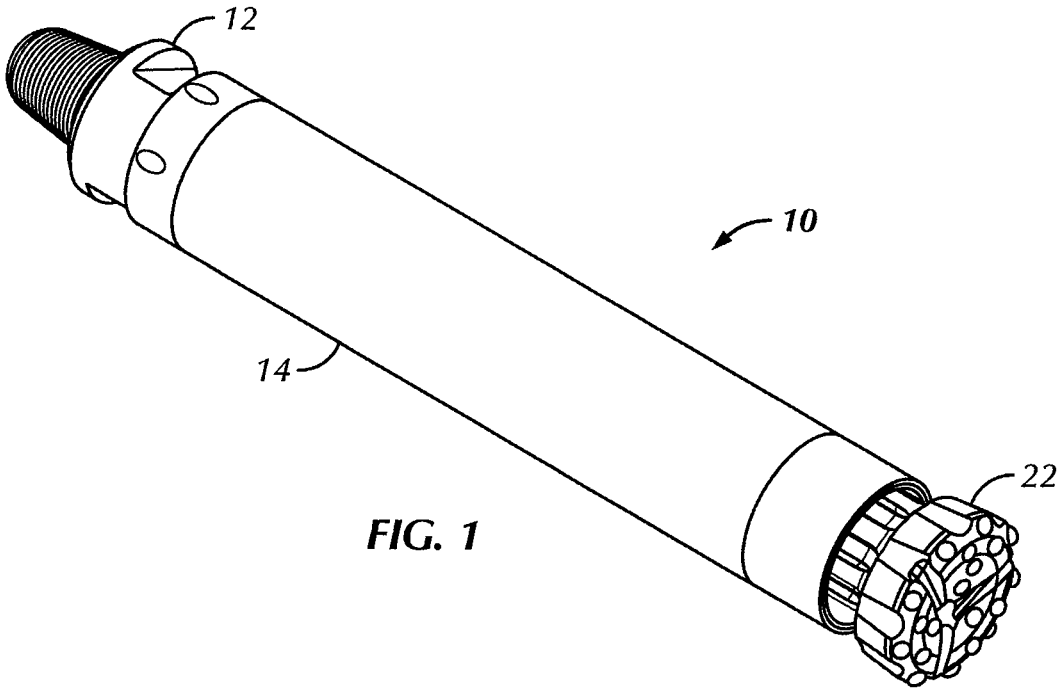
FIG. 1 is a perspective view of a DHD hammer in a drop down position in accordance with a preferred embodiment of the present invention.

Certain terminology is used in the following description for convenience only and is not limiting. The words "right," "left," "upper," and "lower" designate directions in the drawings to which reference is made. For purposes of convenience, "distal" is generally referred to as toward the drill bit end of the DHD hammer, and "proximal" is generally referred to as toward the backhead end of the DHD hammer. "Superior" means generally above or top, while "inferior" means generally below or bottom. Unless specifically set forth herein, the terms "a," "an" and "the" are not limited to one element but instead should be read as meaning "at least one." The terminology includes the words above specifically mentioned, derivatives thereof, and words of similar import.

In a preferred embodiment, the present invention provides for a DHD hammer 10, as shown in FIGS. 1-4, for use with a conventional down-the-hole drill pipe (not shown). The DHD hammer 10 includes a backhead 12, a housing 14, a piston 16, a bearing 18, a chuck assembly 20 and a drill bit 22.

Figure 4:
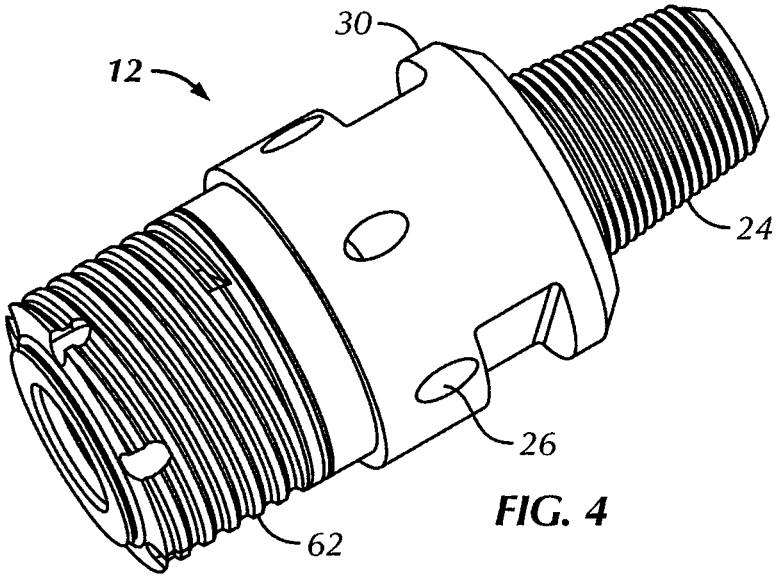
FIG. 4 is a perspective view of a backhead of the DHD hammer of FIG. 1.
Figure 2:
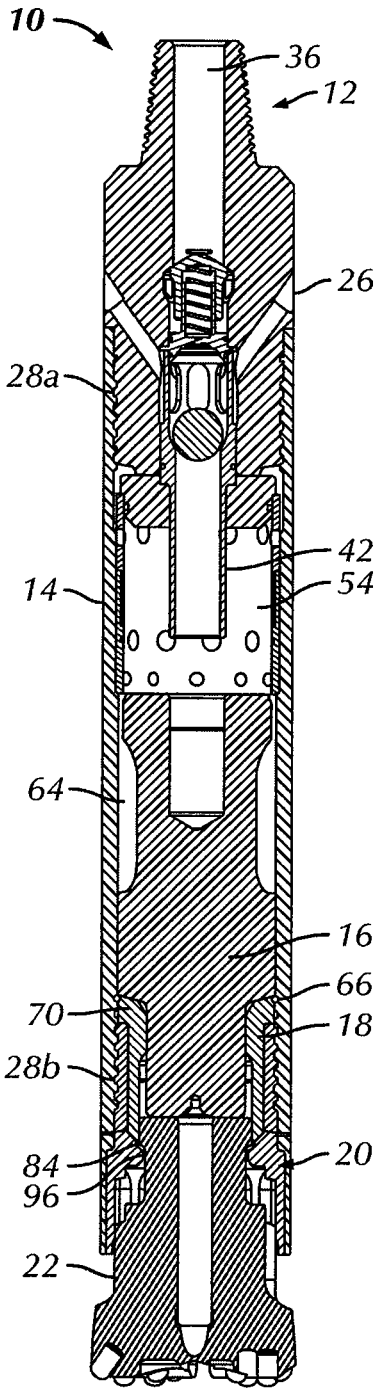
FIG. 2 is a cross-sectional elevational view of the DHD hammer of FIG. 1.
Figure 3:
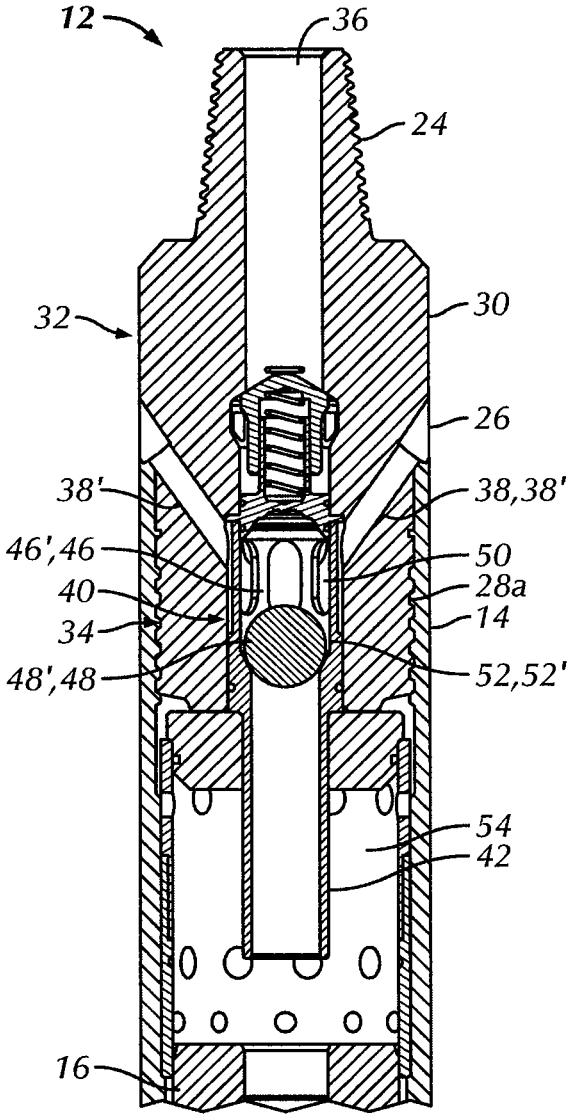
FIG. 3 is an enlarged cross-sectional elevational view of a proximal end of the DHD hammer of FIG. 1 with the check valve assembly in a closed position.

The backhead 12 includes a proximal end configured with threads 24 for connecting to a drill pipe (not shown). The drill pipe can be any conventional drill pipe whose structure, function and operation are well known to those skilled in the art. A detailed description of the structure, function and operation of the drill pipe is not necessary for a complete understanding of the present embodiment. However, the drill pipe supplies the DHD hammer 10 with high pressure fluid, such as air, feed force, and rotation. It will be appreciated that while air is the preferred gas used in conjunction with the present invention, some other gas, combination of gases or fluids could also be used. The drill pipe is also typically smaller in diameter than the DHD hammer 10. The backhead 12 is configured partially within a proximal end of the housing 14. As shown in FIGS. 2-4, a distal portion of the backhead 12 can reside within the housing 14 with a proximal portion of the backhead 12 extending out of the housing 14.

The housing 14 is configured to house the internal working components of the DHD hammer 10. The housing 14 (also known as a casing or wear sleeve) can be an elongated housing and is preferably an elongated cylindrical housing 14. The housing 14 also includes threads 28*a*, 28*b* about its proximal end (28*a*) and its distal end (28*b*) for connecting to the backhead 12 and a chuck assembly 20, respectively as further described in detail below. The housing 14 is also operatively connected to the backhead 12 to provide rotational translation to the DHD hammer 10. That is, as the drill pipe rotates, it rotates the backhead 12 which thereby rotates the housing 14 and consequently the drill bit 22.

Referring to FIGS. 3 and 4, the backhead 12 includes a tubular member 30 having an upper end 32 that extends out of the housing 14 and a lower end 34 housed within the housing 14. When the backhead 12 is assembled to the housing 14, the backhead 12 is superior to the piston 16 of the DHD hammer 10. The tubular member 30 includes a supply inlet 36 for receiving a supply of working fluid volumes from the drill pipe. The supply inlet 36 is configured as a cylindrical bore through the proximal end of the tubular member 30 with a longitudinal axis inline with a central longitudinal axis of the DHD hammer 10. Typically, the supply pressure feed to the supply inlet 36 can be from about 300 to 350 p.s.i.

The backhead 12 also includes an exhaust port 38, a check valve assembly 40, and an exhaust valve stem 42. The exhaust port 38 extends from the check valve assembly 40 to an opening 26 along the backhead's exterior providing a flow path to allow working fluid volumes to be exhausted out of the backhead 12. The check valve assembly 40 is configured about a central portion of the tubular member 30 and includes a generally cylindrical frame 46 and a plug seal 48. The generally cylindrical frame 46 is preferably positioned with its central longitudinal axis inline with the longitudinal axis of the DHD hammer 10 and the tubular member 30. The check valve assembly 40 is in communication with the exhaust port 38 and the exhaust check valve stem 42, and configured to operatively seal the exhaust valve stem 42 when in a closed configuration.

Figure 5:
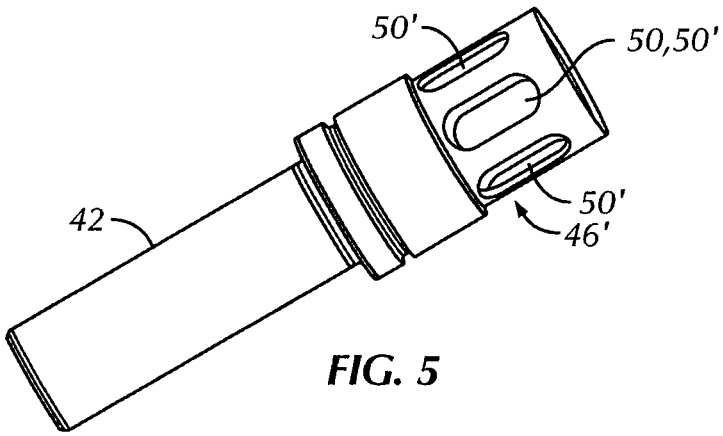
FIG. 5 is a perspective view of a guide cage and an exhaust valve stem of the DHD hammer of FIG. 1.

Preferably, the generally cylindrical frame 46 is configured as a guide cage 46', as best shown in FIGS. 3 and 5. The guide cage 46' includes an aperture 50 in communication with the exhaust port 38. The aperture 50 is aligned with the exhaust port 38 to minimize flow resistance and buildup of backpressure within the interior of the DHD hammer 10, such as a drive chamber 54 of the DHD hammer 10. The aperture 50 can alternatively be configured as any other type of opening that allows for the flow of fluids from the exhaust valve stem 42 to the exhaust port 38, such as a slot, an oblong opening or a circular opening. Preferably, the guide cage 46' is configured with a plurality of apertures e.g., 50' (only three shown for illustration purposes), each of the plurality of apertures 50' is in communication with a plurality of exhaust ports 38' (only two shown for illustration purposes), respectively.

The guide cage 46' includes a proximal end and a distal end. The aperture 50 is configured about the proximal end of the guide cage 46' such that the proximal end is in communication with the exhaust port 38. The distal end is configured to receive the plug seal 48 and with an edge 52, such as a chamfer 52' (FIG. 3). Alternatively, the chamfered edge 52' can be configured as a fillet edge 52" (FIG. 3). The edge 52 is directly connected to the exhaust valve stem 42 such that the distal end of the guide cage 46' is connected to the exhaust valve stem 42.

The plug seal 48 is generally sized and shaped to fit with the guide cage 46' and to move freely therein. When the plug seal 48 is moved to its most proximal position i.e., a first position or an open position (FIG. 3A), the exhaust port 38 is in communication with the guide cage 46' and the exhaust valve stem 42. When the plug seal 48 is moved to its most distal position i.e., a second position or closed position (FIG. 3), the plug seal 48 engages the chamfered edge 52' of the guide case 46'. The plug seal 48 is movable to the second position by gravity. Preferably, the plug seal 48 directly contacts the chamfered edge 52'. By directly engaging the chamfered edge 52', the plug seal 48 provides a seal i.e., seals the exhaust valve stem 42 so that the exhaust port 38 is not in communication with the exhaust valve stem 42. Preferably, the edge 52 is configured with a cross-sectional profile to match a cross-sectional profile of an exterior surface of the plug seal 48, such as fillet edge 52". Overall, the check valve assembly 40 has a closed position (FIGS. 3 and 3B) and an open position (FIG. 3A) for operatively controlling the flow of working fluid volumes from within the DHD hammer 10 to the DHD hammer's exterior and for controlling the flow of fluids and debris from the DHD hammer's exterior from entering the interior of the DHD hammer 10.

The plug seal 48 is preferably configured with a structural configuration and density such that the plug seal 48 can float or be raised within the guide cage 46' to the first position by working fluid volumes being exhausted by from the DHD hammer's drive chamber 54. In an exemplary embodiment, the drive chamber 54 can be configured to exhaust working fluid volumes with an exhaust pressure through the exhaust valve stem 42 sufficient to raise the plug seal 48 to the open position. For example, a plug seal 48 configured as a ball seal 48' having an overall diameter of 1¾ inches, a weight of 0.06 lbs. and a seal diameter of about 1.32 inches will require a pressure of about 0.04 p.s.i. to raise the ball seal 48' to the open position. Thus, a DHD hammer configured with such a ball seal 48' having a seal diameter of about 1.32 inches (i.e., an exhaust valve stem 42 having a diameter of about 1.32 inches), can be configured to exhaust working fluid volumes through the exhaust valve stem 42 at a pressure from about 20 to 80 p.s.i., which is sufficient to raise the ball seal 48' to the open position. While the exact weight and/or density of the plug seal 48 will depend upon the actual size of the DHD hammer 10, the drive chamber 54, and the exhaust valve stem 42, due to the relatively high pressure working fluid volumes traversing the DHD hammer 10 during normal operations, the DHD hammer 10 can be configured to exhaust pressures sufficient to raise a plug seal 48 of any practical configuration. This is due in part because the drive chamber 54 can typically exhaust about ⅔ of the total air consumption of the DHD hammer 10 and because the plug seal 48 is configured with a relatively low cracking pressure.

The plug seal 48 is preferably formed from a soft solid polymer, such as an elastomer. Additional preferred soft solid polymers include polyurethane, neoprene, nitrile rubber and the like, and soft solid polymers preferably having a Shore A hardness from about 50-90 and more preferably from about 70-90 Shore A. The density of the plug seal 48 is preferably higher than the density of water (i.e., 1 g/ml) and more preferably about 20% greater than that of water.

The plug seal 48 is preferably configured as a ball seal 48', as shown in FIG. 3. However, the plug seal 48 can be configured with any other structural shape so long as the plug seal 48 can move freely within the guide cage 46' and sealingly engage with the edge 52. A spherical ball seal 48' is preferred due to its uniform shape in all three dimensions and the ability of fluids to flow past the spherical shape of the ball seal 48'. Furthermore, the ball seal 48' can easily engage a fillet edge 52" of the guide cage 46' regardless of its orientation relative to the fillet edge 52". That is, the ball seal 48' can sealingly engage a correspondingly matched fillet edge 52" of the distal end of the guide cage 46' regardless of its orientation relative to the guide cage 46' itself.

Figure 3A:
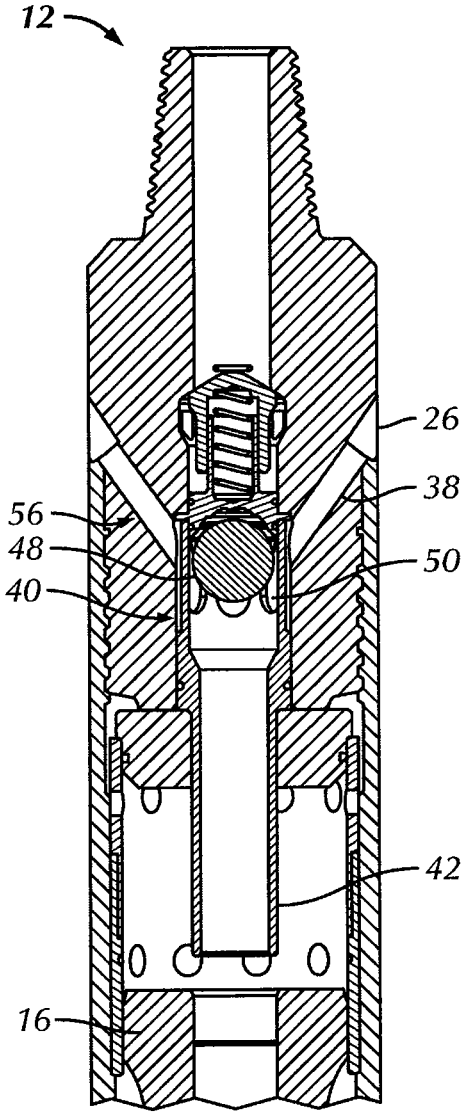
FIG. 3A is an enlarged cross-sectional elevational view of a proximal end of the DHD hammer of FIG. 1 with the check valve assembly in an open position.
Figure 3B:
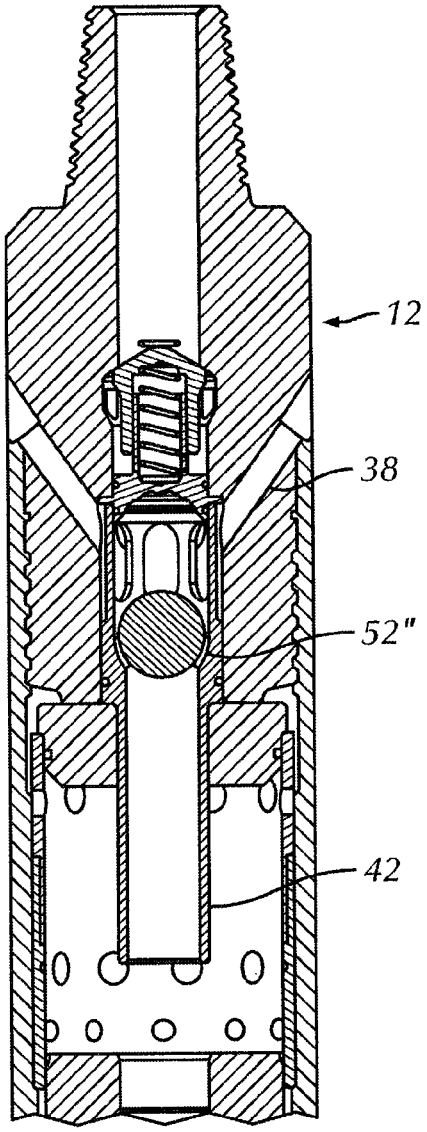
FIG. 3B is an enlarged cross-sectional elevational view of a proximal end of the DHD hammer of FIG. 1 with the check valve assembly having a fillet edge in accordance with another aspect of the present invention.

Referring to FIG. 3A, the exhaust port 38 is in communication with the check valve assembly 40 and the exhaust valve stem 42. The exhaust port 38 is also in communication with the opening 26 of the backhead 12 to allow for working fluid volumes within the DHD hammer 10 to be exhausted to the DHD hammer's exterior. The exhaust port 38 is preferably configured as a cylindrical port with an inner end 56 in communication with the opening 50 and an outer end 56 in communication with the opening 26. The exhaust port 38 of the backhead 12 thereby exhausts working fluid volumes from within the DHD hammer 10 to a proximal end of the DHD hammer's exterior. This configuration advantageously results in the exhausted working fluid volumes from the drive chamber 54 to be expelled significantly above the drill bit 22 thereby decreasing the secondary effects of debris flow across the face of the drill bit 22 resulting from such working fluid volumes being expelled through the drill bit 22. The distal end of the backhead 12 also includes threads 62 (FIG. 4) configured to engage corresponding threads 28a (FIG. 2) of the housing 14 to connect the backhead 12 thereto.

Figure 6:
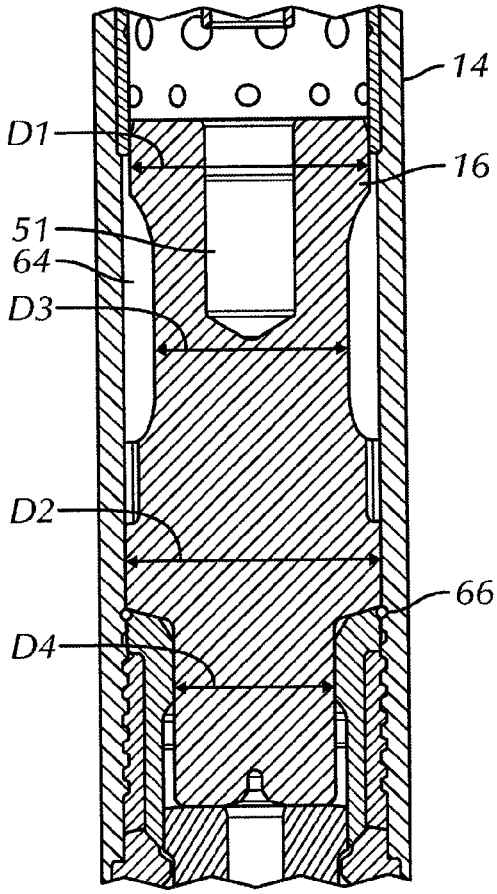
FIG. 6 is a cross-sectional elevational view of a middle portion of the DHD hammer of FIG. 1 showing a piston in the drop down position.
Figure 7:
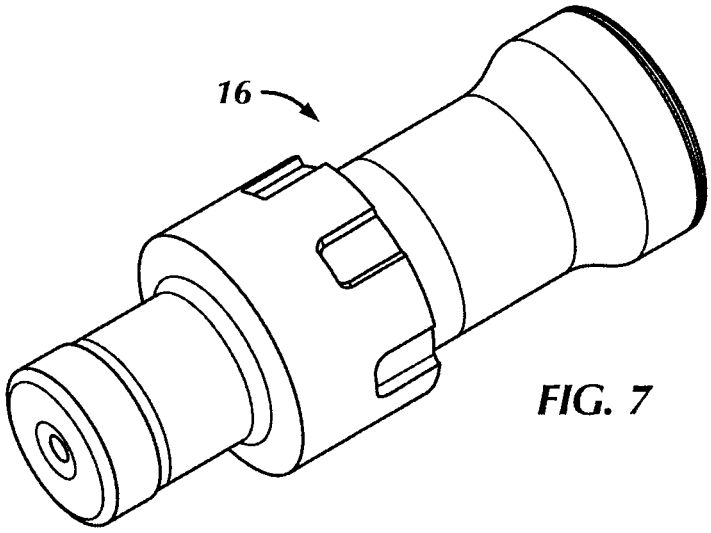
FIG. 7 is a perspective view of the piston of FIG. 6.
Figure 8:
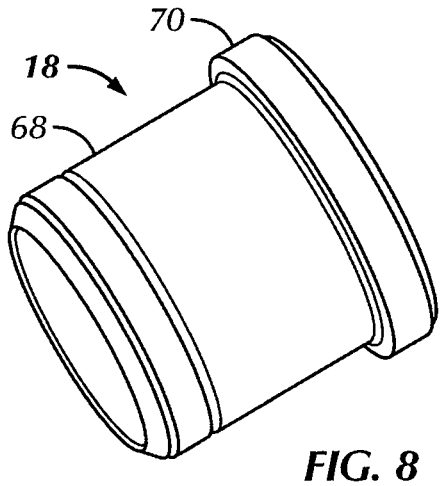
FIG. 8 is a perspective view of a bearing of the DHD hammer of FIG. 1.

The piston 16 is generally configured, as shown in FIGS. 2, 6 and 7. The piston 16 includes spaced apart major cross-sectional areas D1 and D2 and spaced apart minor cross-sectional areas D3 and D4. Major cross-sectional area D1 is configured about the most proximal end of the piston 16 and sized to be housed within the housing 14. Major cross-sectional area D2 is configured distal to major cross-sectional area D1 and sized to be housed within the housing 14. The minor cross-sectional area D3 is configured between the major cross-sectional areas D1 and D2 to form part of a generally annular reservoir 64 which is between an outer surface of the piston 16 and an inner surface of the housing 14. The minor cross-sectional area D4 is configured distal to the major cross-sectional area D2 and generally defines the overall dimensions of the lower portion or distal end of the piston 16.

The piston 16 also includes a central bore 51 (e.g., a counterbore) configured along a central axis of the piston 16, as shown in FIG. 6. The central bore 51 is sized to receive the distal end of the exhaust valve stem 42. The piston 16 is mounted within the DHD hammer 10 and configured to reciprocatively move within the housing 14 along a longitudinal direction in a well known manner known in the art. Such operational and functional aspects of the piston 16 is well known and a detailed description of them is not necessary for a complete understanding of the present invention.

The piston 16 is a solid core piston 16. That is, the piston 16 does not include a bore that completely traverses the length of the piston 16 to allow working fluid volumes to be exhausted through the piston 16.

Figure 11:
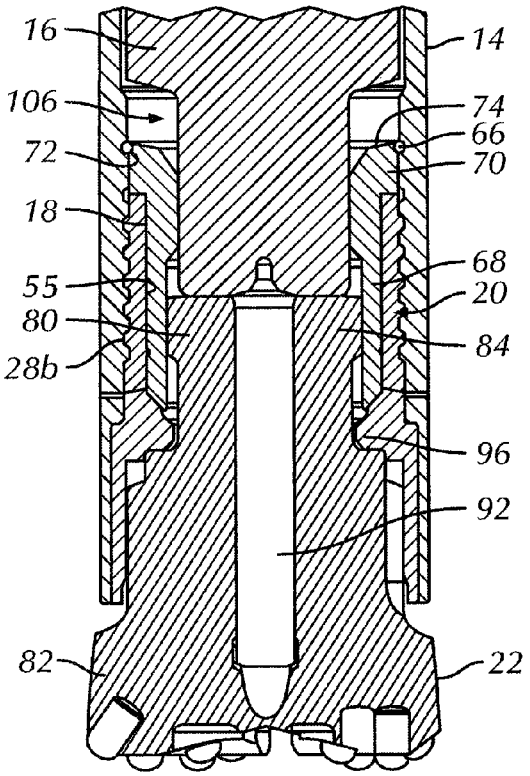
FIG. 11 is an enlarged cross-sectional elevational view of a distal end of the DHD hammer of FIG. 1, with the DHD hammer in an impact position.

The distal end of the DHD hammer 10 includes the bearing 18, the chuck assembly 20, the drill bit 22 and a seal 66 (FIG. 2). The seal 66 is positioned between the piston 16 and the housing 14. The bearing 18 is best shown in FIGS. 2, 8, 10 and 11. Referring to FIGS. 8-11, the bearing 18 is an annular bearing having an annular side wall 68 and a flange 70 about a proximal end of the bearing 18. The flange 70 is a radially outwardly extending flange 70 configured to engage the chuck assembly 20. As best shown in FIG. 11, the flange 70 is in direct contact with the chuck assembly 20 and the housing 14. The proximal end of the bearing 18 also includes an annular recess 72 to receive the seal 66, which is preferably an O-ring seal 66. The annular recess 72 is configured about a lateral aspect of a superior surface 74 of the bearing 18, such that the seal 66 directly contacts the bearing 18 and the piston 16 when the piston 16 is in the drop down position/configuration. In general, the seal 66 is located about the outer edge of the superior surface 74 of the bearing 18.

Figure 9:
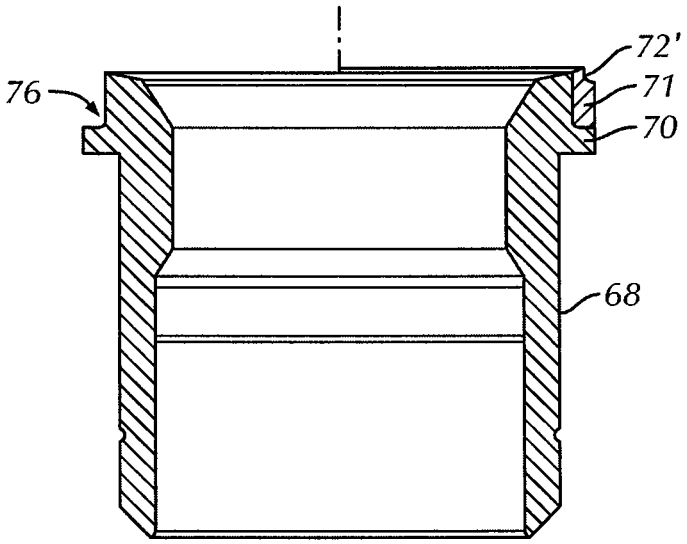
FIG. 9 is a cross-sectional elevational view of the bearing of FIG. 8.
Figure 10:
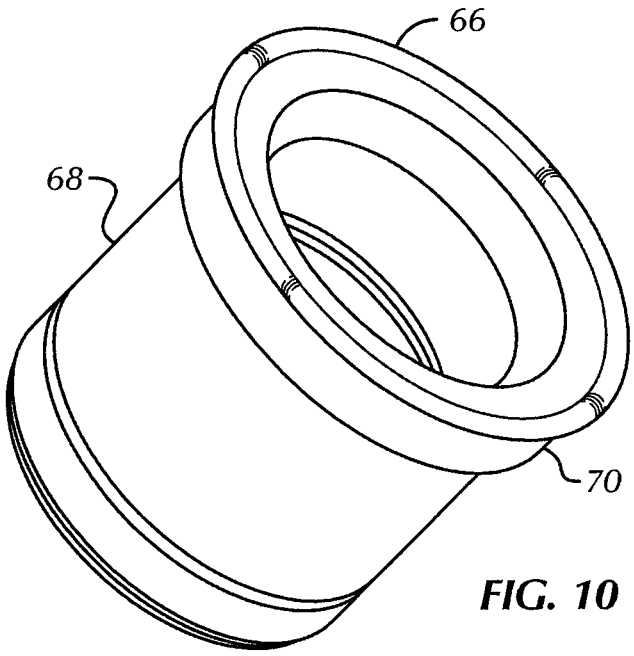
FIG. 10 is a perspective view of the bearing of the FIG. 8 with a seal.
Figure 12:
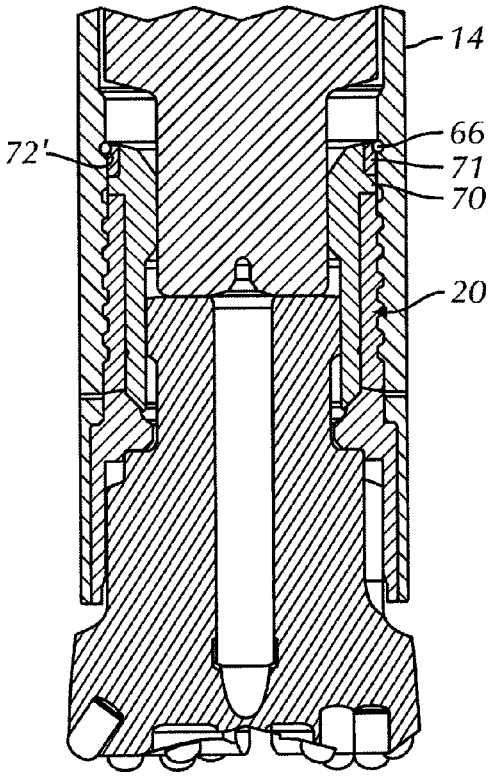
FIG. 12 is an enlarged cross-sectional elevational view of a distal end of the DHD hammer of FIG. 1, with the DHD hammer in an impact position and an alternative embodiment of the DHD hammer's bearing.

Alternatively, the bearing 18 can include a spacer 71 configured as an annular spacer 71, that resides within a relief 76 of the bearing (FIGS. 9 and 12). The spacer 71 can also be configured to include an annular recess 72' for receiving the seal 66.

The seal 66 can be formed from any material capable of forming a seal, such as a hermetic seal. The seal 66 can be a polymeric seal, such as an elastomer, plastic, composite, or combinations thereof and the like.

Referring back to FIGS. 2 and 11, the bearing 18 is operatively connected to the housing 14 via the chuck assembly 20 and configured to receive both the piston 16 and the drill bit 22. In particular, the bearing 18 is configured to receive a distal end of the piston 16, such as the distal end defined by cross-sectional area D4, and a proximal end of the drill bit 22, such as the proximal end of the shank 80. As the bearing 18 receives both the piston 16 and the drill bit 22, the bearing 18 is a unitized bearing 18 that functions to replace the operations of both a piston bearing and a drill bit bearing in conventional DHD hammers.

The bearing 18 is mounted within the housing 14, as best shown in FIG. 11. The overall diameter of the flange 70 is sized to substantially match that of the inside diameter of the housing 14. That is, the overall diameter of the flange 70 is toleranced to allow the bearing 18 to slide within the housing 14 but without any significant play within the housing 14. The difference between the overall diameter of the flange 70 and the outside diameter of the annular wall 68 is configured to substantially match the wall thickness of the chuck assembly 20, as further described below. In sum, the bearing 18 is configured to operatively engage the piston 16, the drill bit 22, the chuck assembly 20 and the housing 14.

When assembled within the DHD hammer 10, the bearing's flange 70 is superior to the chuck assembly 20 while the bearing's annular wall is adjacent the proximal end of the chuck assembly 20. As shown in FIG. 11, the bearing's annular wall is adjacent the chuck assembly's radially inwardly facing surface 55. The bearing 18 and chuck assembly 20 configuration is thereby configured to receive both the piston 16 and the drill bit 22. That is, in operation, the piston 16 and the drill bit 22 are operatively received within the annular confines of both the bearing 18 and the chuck assembly 20.

Figure 13:
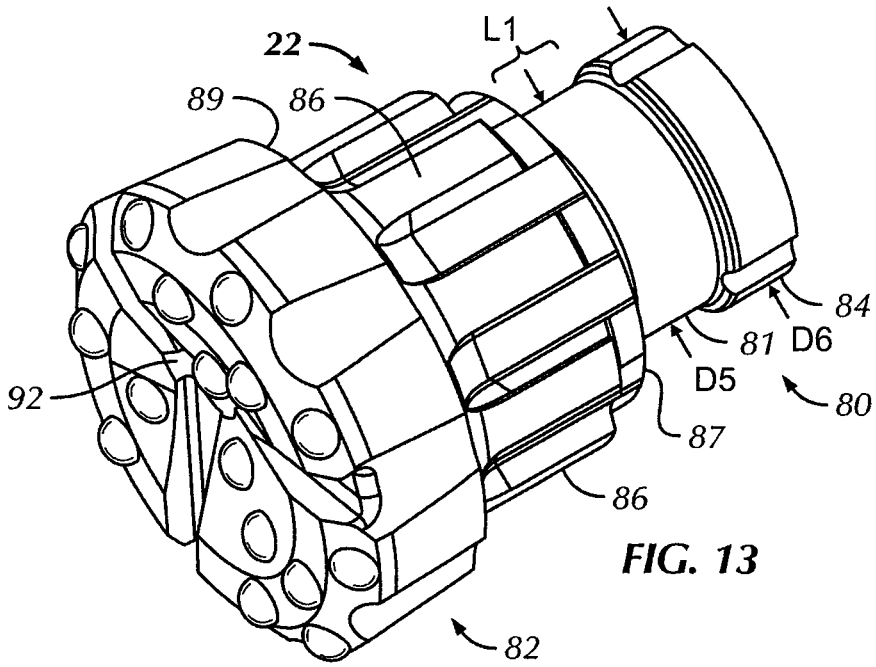
FIG. 13 is a distal perspective view of a drill bit of the DHD hammer of FIG. 1.

As best show in FIGS. 11 and 13, the drill bit 22 is configured about a distal end of the housing 14. The drill bit 22 includes a shank 80, a shank body 81, a head 82 and a return exhaust 92 for exhausting working fluid volumes within a return chamber 106 of the DHD hammer 10. The shank 80 generally extends proximally from the head 82. The longitudinal length of the shank 80 is about 1.5 to 3.0 and more preferably about 1.7 to 2.0 times the longitudinal length of the head 82.

The shank 80 also includes a shoulder 84 that extends radially outwardly from the shank 80 and is configured about a proximal end of the shank 80. The shoulder 84 serves as a retaining shoulder for retaining the drill bit 22 on the DHD hammer 10 when the piston 16 is in the "drop down" position. The drop down position refers to when working pressure volumes are no longer being supplied to the DHD hammer 10 and the piston 16 and the drill bit 16 are free to hang from (or relative to) the housing 14. FIG. 2 illustrates the DHD hammer 10 in the drop down position. FIG. 11 illustrates the DHD hammer 10 in an impact position. The shoulder 84 is retained by the DHD hammer 10 by interaction with the chuck assembly 20, as further discussed below.

Figure 13A:
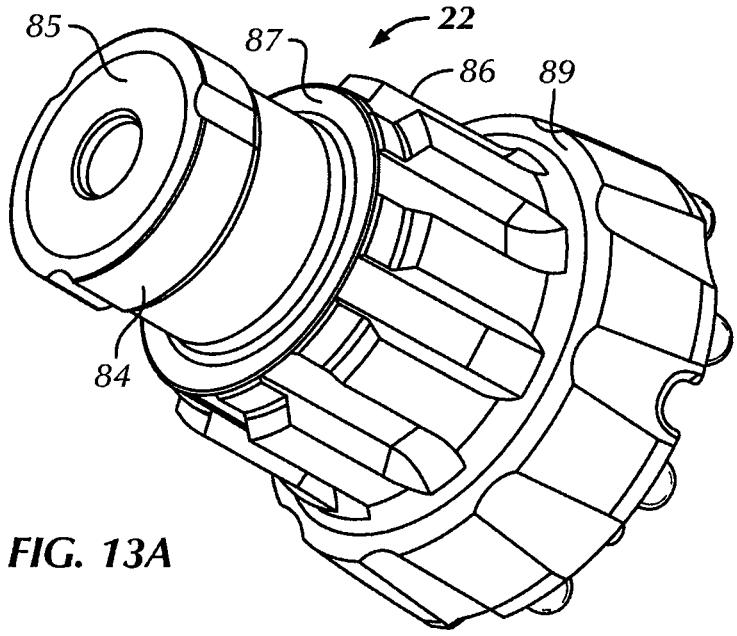
FIG. 13A is a proximal perspective view of the drill bit of FIG. 13.
Figure 14:
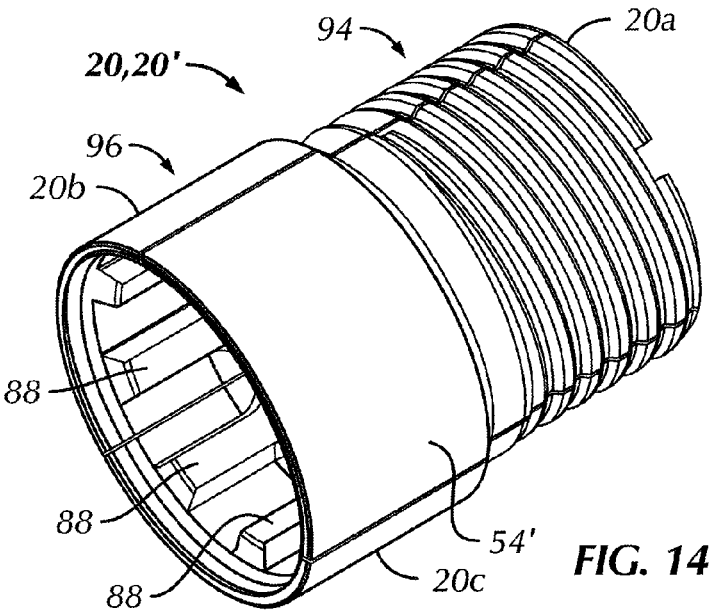
FIG. 14 is a perspective view of a segmented chuck assembly of the DHD hammer of FIG. 1.

The shank 80 also includes an impact surface 85, a thrust shoulder 87 and a plurality of shank splines 86 circumscribing the shank 80 that extend radially outwardly for engaging corresponding chuck splines 88 on the chuck assembly 20 (FIG. 14). The impact surface 85 is configured as a superior surface of the shank 80 and located about a proximal end of the shank 80, as best shown in FIG. 13A. The shank splines 86 are located about a distal end of the shank 80, proximal to the head 82 and distal to the shoulder 84. The overall diameter of the shoulder 84 being less than the overall diameter of the shank splines 86. The thrust shoulder 87 is proximate a proximal end of the shank splines 86 and distal to the impact surface 85 and the shoulder 84. The thrust shoulder 87 extends radially inwardly from the external surfaces of the shank splines 86 and is preferably a planar thrust shoulder 87 that is perpendicular to a longitudinal axis of the shank 80. The overall diameter of the thrust shoulder 87 is greater than the overall diameter of the shoulder 84 but less than the overall diameter of the shank splines 86. The thrust shoulder 87 is also preferably spaced apart from the shoulder 84.

The head 82 is configured to reside completely outside and inferior to the housing 14 (see FIG. 1). As such, the size of the head 82 is not limited to the size of the housing 14, but can be advantageously configured to be as large as possible without restrictions owing to the housing 14. The drill bit 22 also includes a bit shoulder 89 configured proximate a proximal end of the head 82 and a distal end of the shank splines 86, as best shown in FIG. 13A. That is, the bit shoulder 89, about the intersection of the shank 80 and head 82, extends radially outward from shank 80. The overall diameter of the bit shoulder 89 is greater than the overall diameter of the thrust shoulder 87 and shank splines 86.

In operation, the thrust shoulder 87 operatively engages with the DHD hammer 10 such that the DHD hammer 10 thrusts upon the thrust shoulder 87 to force the drill bit 22 to contact a drilling surface. In particular, the thrust shoulder 87 is configured to operatively engage and directly contact a flange of a chuck assembly, such as an inferior surface 102 of flange 96 of the chuck assembly 20 or a segmented chuck assembly 20' (FIG. 15), as described below. The configuration of the thrust shoulder 87 higher up on the drill bit 22 (i.e., above the shank splines 86) advantageously promotes alignment of the drill bit 22 within the housing 14 and further helps prevent the occurrence of debris accumulation or entrapment of debris at the thrust shoulder 87. That is, the thrust shoulder 87 is located higher up on the drill bit 22 and consequently higher up within the housing 14, which helps prevent the accumulation and/or entrapment of debris therein. This is significant over the prior art where the thrust shoulder is lower and nearer the head of the drill bit and directly exposed to debris, especially when in the drop down position. As such, when debris accumulates or gets entrapped within the thrust shoulder of such conventional DHD hammers, the drill bit can be prevented from reaching its actuating position and/or prevent the hammer's piston from actuating.

Figure 15:
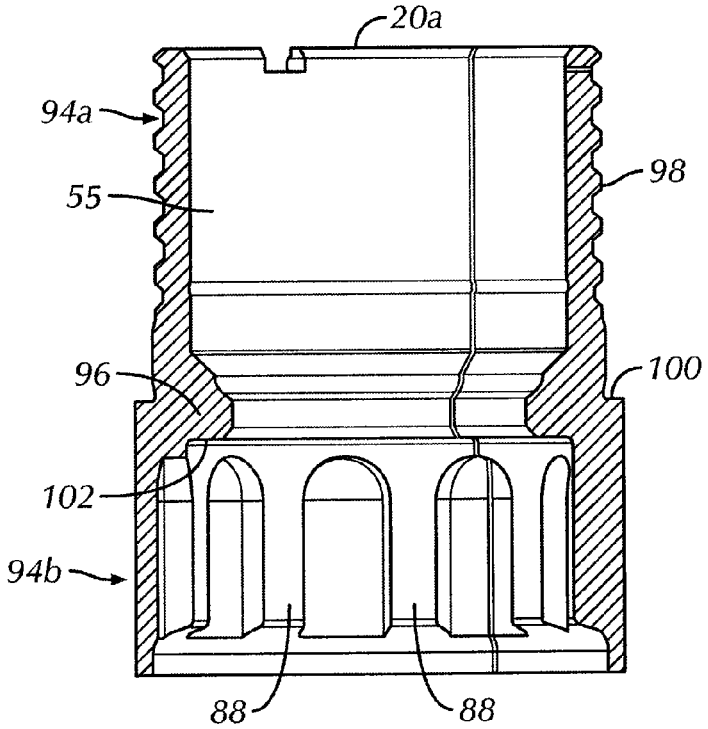
FIG. 15 is a cross-sectional elevational view of the segmented chuck assembly of FIG. 14.

The chuck assembly 20 is shown in FIGS. 14 and 15. The chuck assembly 20 is preferably a segmented chuck assembly 20' with three individual chuck segments 20*a-c*. While three chuck segments are preferred, the segmented chuck assembly 20' can be configured with a plurality of chuck segments more or less then three. Each chuck segment e.g., 20*a*, is an arch-shaped chuck segment having an arch range of about 120 degrees. In particular, the chuck segment's inner surface 55 is concavely arched, while the chuck segment's outer surface 54' is convexly arched. Collectively, chuck segments 20*a-c* are assembled to form a cylindrical chuck assembly that circumscribes the drill bit 22 (FIG. 11).

When assembled within the DHD hammer 10, the bearing 18 is partially housed within the chuck assembly 20 (FIG. 11). The bearing 18 is confined within the chuck assembly 20 by radially inward pressure developed by the chuck assembly's threaded engagement with the housing's threads 28*b*. The bearing 18 and chuck assembly 20 configuration advantageously allows for the DHD hammer 10 to utilize a shorter drill bit 22, compared to traditional DHD hammer drill bits. That is, for traditional DHD hammers, the bearing is situated above the chuck assembly. Thus, the drill bit for traditional DHD hammers needed to be of sufficient length to operatively engage both the chuck assembly and the bearing. This was accomplished by the use of drill bits having a length sufficient to extend and reach both the chuck assembly and the bearing located above the chuck assembly. However, the present invention provides for a bearing 18 that at least partially overlays the chuck assembly 20, thereby allowing for the utilization of a shorter drill bit 22 compared to traditional DHD hammer drill bits. Furthermore, the bearing 18 and chuck assembly 20 configuration not only advantageously provides for the utilization of a shorter drill bit 22, but also provides for the utilization of a shorter piston 16 in conjunction with the shorter drill bit 22.

Each of the plurality of chuck segments 20*a-c* are identical and for sake of convenience, the plurality of chuck segments 20*a-c* will now be described with reference to a single chuck segment 20*a*. Chuck segment 20*a* includes a proximal end 94*a*, a distal end 94*b* and a flange 96 about a middle portion of the chuck segment 20*a*. The proximal end 94*a* includes threads 98 configured to engage corresponding threads 28*b* on the housing 14 i.e., the threads 98 enable the segmented chuck assembly 20' to be connectable to the housing 14.

The distal end 94*b* of the chuck segment 20 includes the plurality of chuck splines 88 for engaging the plurality of shank splines 86 on the drill bit 22. When the segmented chuck assembly 20' is assembled, the distal end of the segmented chuck assembly 20' is configured to receive the shank 80 of the drill bit 22. The overall diameter of the distal end 96 is also configured to be larger than the overall diameter of the proximal end 94*a*, thereby forming an outwardly extending ledge 100.

The flange 96 is generally positioned about the intersection of the proximal end 94*a* and the distal end 96*b* of the chuck segment 20*a* (i.e., about a middle section) and serves as a bit retaining element. The flange 96 is a radially inwardly extending flange 96. When each of the plurality of chuck segments 20*a-c* are assembled forming the segmented chuck assembly 20', the flange 96 extends radially inwardly forming an inner diameter of the flange 96 having a dimension that is larger then the shank body 81 outside diameter D5, but smaller than the shoulder 84 outside diameter D6. As such, when the segmented chuck assembly 20' engages the drill bit 22, the flange 96 operatively engages the shoulder 84 of the drill bit 22 thereby retaining the drill bit 22 on the DHD hammer 10 when the DHD hammer 10 is in the drop down position. Preferably, the flange 96 is configured to directly engage the shoulder 84, as shown in FIG. 2. The flange 96 is also configured with an inferior surface 102 configured to engage the thrust shoulder 87 of the shank 80. The segmented chuck assembly 20' thereby advantageously provides for a chuck assembly that includes a bit retaining/thrust bearing element 96. This advantage is provided for in part as the segmented chuck assembly 20' is assembled to the drill bit 22 from a radial direction as opposed to being assembled to the drill bit 22 from an axial direction.

In general, the segmented chuck assembly 20', drill bit 22 and bearing 18 combination can be used in conjunction with any compatible piston of a DHD hammer, such as a solid core piston 16 or a conventional piston having a thru-hole (not shown).

FIG. 2 illustrates a fully assembled DHD hammer 10 in a drop down position. As readily known in the art, the DHD hammer 10 includes a drive chamber 54, a reservoir 64 and a return chamber 106 (FIG. 11). The drive chamber 54 is located between the backhead 12 and piston 16 about a proximal end of the DHD hammer 10 and formed in part by the backhead 12, housing 14 and piston 16. The drive chamber 54 is also configured to be in communication with the exhaust valve stem 42. The reservoir 64 is located between the housing 14 and the piston 16 and formed by the housing 14 and piston 16 walls. The return chamber 106 is located between the piston 16 and the drill bit 22, about a distal end of the DHD hammer 10. The return chamber 106 is formed generally by the walls of the housing 14, piston 16 and drill bit 22.

Figure 2A:
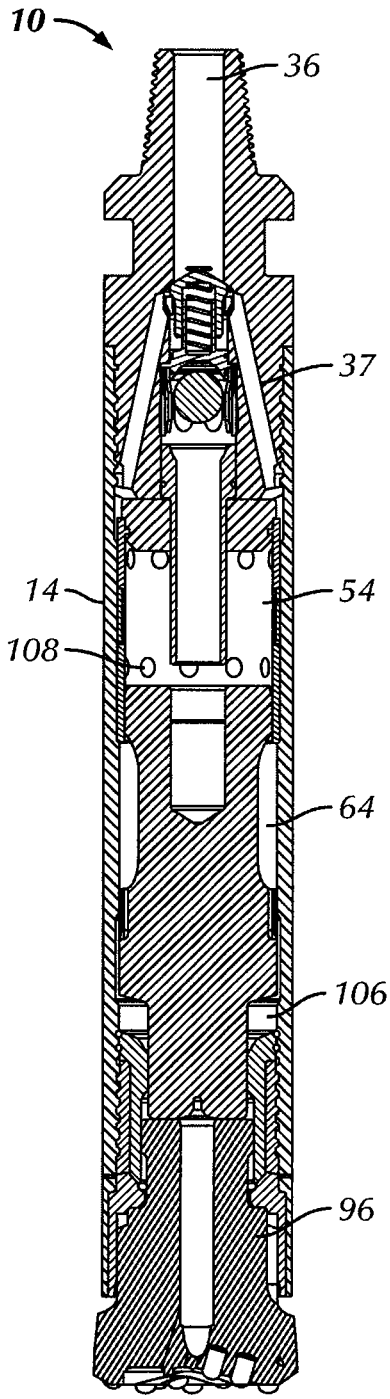
FIG. 2A is a cross-sectional elevational view of the DHD hammer of FIG. 1 in an impact position and with feed ports shown.

The DHD hammer 10 also includes a porting system to provide working fluid volumes e.g., a supply flow, within the DHD hammer 10. Such porting systems are well known in the art and a detailed description of them is not necessary for a complete understanding of the present invention. However, as shown in FIG. 2A, such porting systems can include a central port, such as supply inlet 36 and feed port 37. The feed port 37 provides supply pressure to the DHD hammer 10 via fluid passageways within the housing 14 and into the reservoir 64, drive chamber 54 via blow ports 108 and return chamber 106. Exhaust from the return chamber 106 is expelled from the DHD hammer 10 through the return exhaust 92. Overall, the porting system provides a fluid passageway for the supply and return of working fluid volumes within the drive chamber 54, reservoir 64 and return chamber 106, which are compressed and exhausted to reciprocally drive the piston 16 within the housing 14.

In operation, the piston 16 of the DHD hammer 10 of the present embodiments is percussively driven as a result of alternating high and low pressure fluids e.g., gas entering and existing the drive chamber 104 and return chamber 106. High pressure gas initially enters the DHD hammer 10 through the backhead 12 and passes down the supply inlet 36. The high pressure gas then enters the drive chamber 54 and return chamber 106 through the conventional porting system to percussively drive the piston 16 within the housing 14 along a longitudinal axis of the housing 14.

When operation of the DHD hammer 10 ceases, for example to add additional length segments to the drill pipe, the DHD hammer 10 drops into the drop down position (FIG. 2). When in the drop down position, the piston 16, the bearing 18, the seal 66 and the housing 14 form a seal to prevent fluid communication to the drive chamber 54 from a distal end of the DHD hammer 10.

That is, when in use, the DHD hammer 10 is immersed in water, which likely contains cutting debris. High pressure gas within the DHD hammer 10 during use prevents the ingress of such water and debris into the DHD hammer's interior. If such water and debris enters the DHD hammer's interior it can adversely effect the DHD hammer's operation and performance. However, when in the drop down position, the high pressure gas is turned off, but the seal formed by the piston 16, the bearing 18, the seal 66 and the housing 14 advantageously prevents water and debris from entering the DHD hammer's interior.

The present invention advantageously provides for a DHD hammer 10 that prevents the ingress of water and debris from entering the DHD hammer 10 and in particular the drive chamber 54 when in a non-use state, i.e., when high pressure gases are not being expelled from the DHD hammer 10. In the non-use state, the DHD hammer 10 is in the drop down position. In the drop down position, water and debris is prevented from entering the drive chamber 54 of the DHD hammer 10 by a seal created by the interaction of the solid core piston 16, the bearing 18, the seal 66, and the housing 14. The seal in part is generated by the weight of the piston 16 itself on the seal 66 and its interaction with the bearing 18. The seal thus created prevents the ingress of any water/debris from flowing into the main internal areas of the DHD hammer 10, such as the drive chamber 54. Such sealing capabilities of the DHD hammer 10 is possible owing to the solid core piston 16 configuration.

The proximal end of the DHD hammer 10 is also typically submerged in water/debris when in the non-use state. As such, water/debris can enter the DHD hammer 10 through openings (e.g., opening 26) in the housing 14 of the DHD hammer 10. However, the present invention advantageously provides for a check valve assembly 40 that can seal off the flow of water/debris from entering the main internal areas of the DHD hammer 10, such as the drive chamber 54. That is, the plug seal 48 seals the exhaust valve stem 42, thereby preventing the ingress of water/debris from entering the drive chamber 54. Since the plug seal 48 of the check valve assembly 40 forms a seal upon being acted on by gravity in the absence of high pressure working fluid volumes being expelled from to the DHD hammer 10, additional hydrostatic pressure exerted on the plug seal 48 by the water/debris within the hole just drilled by the DHD hammer 10 will aid to further enhance the plug seal's sealing capability. This is a significant advantage compared to other DHD hammer configurations because the total water/debris column within a drilled hole can generate a hydrostatic pressure that exceeds several hundred feet of water. This hydrostatic pressure build up can significantly stress conventional DHD hammer seals and lead to the contamination of a DHD hammer's main internal areas. However, the present invention's check valve assembly 40 which incorporates a gravity-based seal takes advantage of the drill holes hydrostatic pressure buildup in enhancing the DHD hammer's seal, thereby preventing the ingress of water/debris about the proximal end of the DHD hammer 10 from entering the DHD hammers internal areas, such as the drive chamber 54.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A down-the-hole drill hammer comprising:
- a housing;
- a solid core piston within the housing and configured to prevent the flow of fluids through the solid core piston;
- a seal located between the solid core piston and the housing; and
- a backhead configured within the housing and superior to the solid core piston, the backhead including:
  - an exhaust port in communication with an opening to an exterior of the housing,
  - an exhaust valve stem in communication with the exhaust port, and
  - a check valve assembly configured to seal the exhaust valve stem when in a closed configuration.

2. The down-the-hole drill hammer of claim 1, further comprising:
- a bearing operatively connected to the housing and configured to receive a portion of the solid core piston;
- a drive chamber formed between the backhead and the solid core piston, the drive chamber being in communication with the exhaust valve stem, and
- wherein the solid core piston, the bearing, the seal, and the housing form a seal to prevent fluid communication to the drive chamber from a distal end of the down-the-hole drill hammer when the solid core piston is in a drop down position.

3. The down-the-hole drill hammer of claim 2, wherein the seal directly contacts the bearing and the solid core piston.

4. The down-the-hole drill hammer of claim 2, wherein the seal is located about a superior surface of the bearing.

5. The down-the-hole drill hammer of claim 4, wherein the bearing includes an annular recess for receiving the seal.

6. The down-the-hole drill hammer of claim 1, wherein the check valve assembly comprises a plug seal.

7. The down-the-hole drill hammer of claim 6, wherein the plug seal is a ball seal.

8. The down-the-hole drill hammer of claim 6, wherein the check valve assembly further comprises a guide cage in communication with the exhaust port and the exhaust valve stem, and wherein the plug seal is movable within the guide cage.

9. The down-the-hole drill hammer of claim 8, wherein the plug seal is configured to move between a first position wherein the exhaust port is in communication with the exhaust valve stem and a second position wherein the exhaust valve stem is sealed from being in communication with the exhaust port.

10. The down-the-hole drill hammer of claim 9, wherein the plug seal is movable to the second position by gravity.

11. The down-the-hole drill hammer of claim 8, wherein the guide cage comprises:
- a proximal end in communication with the exhaust port; and
- a distal end in communication with the exhaust valve stem, and wherein the distal end of the guide cage is configured to receive the plug seal to seal the exhaust valve stem.

12. A down-the-hole drill hammer comprising:
a housing having a proximal end situated toward a point of attachment to a drill string and an opposing distal end;
a piston mounted within the housing and configured to reciprocatively move within the housing along a longitudinal direction;
a drill bit proximate the distal end of the housing, the drill bit including:
a head, and
a shank having:
a shoulder,
a distal end, and
an opposing proximal end,
wherein the distal end of the shank is situated toward the distal end of the housing; and
a segmented chuck assembly circumscribing the drill bit, the segmented chuck assembly including:
a plurality of individual and separable chuck segments, each of the chuck segments including:
a proximal end connectable to the housing,
a distal end opposing the proximal end of the chuck segment and configured to receive the shank of the drill bit, and
a flange configured to operatively engage the shoulder of the shank.

13. The down-the-hole drill hammer of claim 12, wherein each of the chuck segments is arch-shaped.

14. The down-the-hole drill hammer of claim 12, wherein the shoulder of the shank is a radially outwardly extending shoulder.

15. The down-the-hole drill hammer of claim 12, wherein the flange is a radially inwardly extending flange.

16. The down-the-hole drill hammer of claim 12, wherein the drill bit further includes a plurality of shank splines having proximal ends situated toward the proximal end of the housing and opposing distal ends, and positioned proximal to the head and distal to the shoulder, and wherein the flange of the segmented chuck assembly includes an inferior surface configured to engage a surface proximate the proximal end of the plurality of shank splines.

17. The down-the-hole drill hammer of claim 12, further comprising a bearing within the housing configured to receive the piston and the drill bit.

18. The down-the-hole drill hammer of claim 17, wherein the bearing is configured to operatively engage the piston, the drill bit, the segmented chuck assembly, and the housing.

19. The down-the-hole drill hammer of claim 17, wherein the segmented chuck assembly is configured to receive the bearing.

20. The down-the-hole drill hammer of claim 17, wherein the segmented chuck assembly and the bearing are configured to receive the piston and the drill bit.

21. The down-the-hole drill hammer of claim 17, wherein the bearing comprises:
an annular side wall; and
a flange about a proximal end of the bearing configured to engage the segmented chuck assembly, the proximal end of the bearing being situated toward the proximal end of the housing.

22. The down-the-hole drill hammer of claim 21, wherein the flange is in direct contact with the segmented chuck assembly and the housing.

23. The down-the-hole drill hammer of claim 12, wherein the drill bit further includes:
a plurality of shank splines about the distal end of the shank;
a thrust shoulder located proximate the proximal end of the shank splines and distal to the shoulder; and
a bit shoulder located proximate the distal end of the shank splines,
wherein the thrust shoulder is operatively engaged with and in direct contact with the flange of the segmented chuck assembly.

24. The down-the-hole drill hammer of claim 12, wherein each of the plurality of individual and separable chuck segments are separate and separable from one another, and wherein each of the distal ends of the plurality of individual chuck segments includes a plurality of splines and each of the proximal ends of the plurality of individual chuck segments includes threads for connecting to the housing.

25. A cylindrical chuck assembly for circumscribing a drill bit of a down-the-hole drill hammer comprising:
a non-unitary cylindrical chuck having a plurality of individual chuck elements configured to assemble into the cylindrical chuck assembly, each of the plurality of chuck elements including:
a proximal end for fastening to a down-the-hole drill hammer housing,
a distal end for receiving the drill bit, and
a flange for operatively engaging the drill bit.

26. The cylindrical chuck assembly of claim 25, wherein the flange is a radially inwardly extending flange for retaining the drill bit when the drill bit is in a drop down position.

27. The cylindrical chuck assembly of claim 25, wherein the split cylindrical chuck is split along a length substantially parallel to a central longitudinal axis of the cylindrical chuck assembly.

28. A down-the-hole hammer, comprising:
a housing having a proximal end situated toward a point of attachment to a drill string and an opposing distal end;
a piston mounted within the housing and configured to reciprocatively move within the housing along a longitudinal direction;
a drill bit proximate the distal end of the housing, the drill bit including:
a head having a distal end situated toward the distal end of the housing and an opposing proximal end,
a bit shoulder proximate the proximal end of the head, and
a shank extending proximally from the head, the shank having:
a distal end situated toward the distal end of the housing and an opposing proximal end,
an impact surface about the proximal end of the shank,
a shoulder proximate the proximal end of the shank,
a plurality of shank splines about the distal end of the shank, the plurality of shank splines having distal ends situated toward the distal end of the housing and opposing proximal ends, and
a thrust shoulder proximate to the proximal end of the plurality of shank splines and spaced from the impact surface; and
a chuck assembly circumscribing the drill bit and connected to the housing, the chuck assembly including a flange in direct contact with the thrust shoulder of the drill bit.

29. A drill bit for a down-the-hole drill hammer comprising:
a head; and
a shank extending from the head, the shank including:
a first end distal to the head and an opposing second end,
a first shoulder proximate the first end of the shank, a plurality of splines having proximal ends situated toward the first end of the shank and opposing distal ends, and positioned proximate the second end of the shank, and a thrust shoulder spaced from the first shoulder and positioned adjacent to the proximal end of the plurality of splines.

30. The drill bit of claim 29, wherein the head includes a bit shoulder adjacent the plurality of splines.

31. The drill bit of claim 29, wherein the thrust shoulder has a proximally facing surface positioned adjacent the plurality of splines.

32. The drill bit of claim 29, wherein the shank has an axially extending longitudinal length of about 1.5 to 3.0 times greater than the axially extending longitudinal length of the head.

33. The drill bit of claim 29, wherein the shank has an axially extending longitudinal length of about 1.7 to 2.0 times greater than the axially extending longitudinal length of the head.

34. The drill bit of claim 29, wherein the plurality of splines circumscribes the second end of the shank.

35. The drill bit of claim 29, wherein the overall width of the thrust shoulder is greater than the overall width of the shoulder.

36. The drill bit of claim 35, wherein the overall width of the thrust shoulder is less than the overall diameter of the shank splines.

37. A non-unitary segmented chuck assembly for a down-the-hole drill hammer comprising:

a plurality of individual chuck elements for circumscribing a drill bit, each of the plurality of chuck elements including:

a proximal end connectable to a down-the-hole drill hammer housing, the proximal end including threads for connecting to the housing, a distal end configured to receive the drill bit, the distal end including a plurality of splines, and a flange configured to operatively engage the drill bit.

* * * * *